United States Patent [19]

Askinazi

[11] Patent Number: 4,832,212

[45] Date of Patent: May 23, 1989

[54] TIP-FREE, STACKABLE, DISPOSABLE CUP

[76] Inventor: Clifford Askinazi, P.O. Box 353, Sudbury, Mass. 01776

[21] Appl. No.: 145,361

[22] Filed: Jan. 19, 1988

[51] Int. Cl.[4] ..... B65D 21/02

[52] U.S. Cl. ..... 215/10; 206/503; 206/519; 206/520; 229/1.5 B; 229/4.5; 229/915

[58] Field of Search ..... 215/10, 1 R; 229/1.5 B, 229/1.5 C, 4.5, 915; 206/503, 519, 520, 499

[56] References Cited

U.S. PATENT DOCUMENTS

| | | | |
|---|---|---|---|
| 2,061,496 | 11/1936 | Wright | 229/4.5 |
| 2,581,516 | 1/1952 | Cohen | 229/1.5 B |
| 3,471,075 | 10/1969 | Wolf | 229/1.5 B |
| 3,973,693 | 8/1976 | Brocklehurst | 229/1.5 C |

*Primary Examiner*—Sue A. Weaver

[57] ABSTRACT

The invention is a stackable and stable, disposable drinking cup which, by virtue of a base wider than its top, and by virtue of an inner ridge upon the wall of the inverted cone which forms the base, provides for resistance to tipping and the ability to stack.

1 Claim, 1 Drawing Sheet

TIP-FREE, STACKABLE, DISPOSABLE CUP

BACKGROUND

1. Technical Field

This invention is a form of drinking cup which has been designed so as to prevent accidental tipping over but remain stackable.

2. Background Art

Prior art does not solve the dual problems of being stackable and resistant to being easily tipped over, spilling the contents of the cup. Wolf (U.S. Pat. No. 3,471,075) describes a stackable cup, but his invention does not address the problem of accidental tipping. Cohen (U.S. Pat. No. 2,581,516) invented a vessel that is more stable but could not be stacked. Neither Brocklehurst (U.S. Pat. No. 3,973,693) nor Wright (U.S. Pat. No. 2,061,496) address both issues in a single design.

SUMMARY

The invention is a stackable and disposable cup which also, due to its design, provides greater stability than most previous cups. Both elements, stackability and stability, are thus addressed in the same design.

DESCRIPTION OF THE PREFERRED EMBODIMENT

Figure 1:
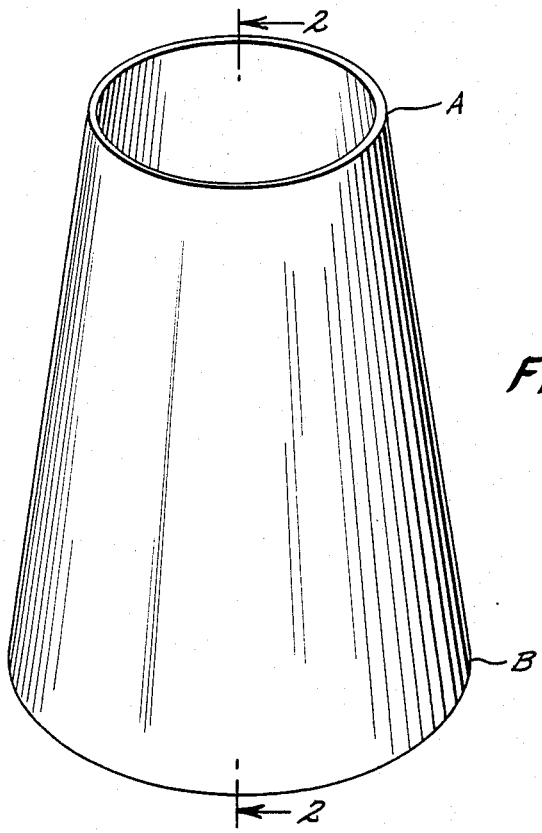
FIG. 1 is an elevational view of the cup.
Figure 2:
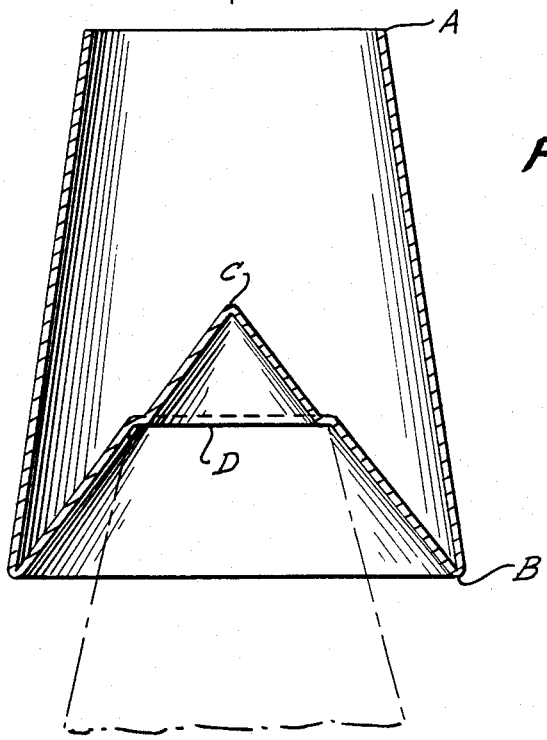
FIG. 2 is a sectional view taken on lines 2—2 of FIG. 1 showing the cup in stacked relation with a second cup, shown in phantom.

The invention is a disposable cup which can be made from styrofoam, rigid waxed paper, or other material suitable for drinking cups. The body of the cup, as depicted in FIG. 1, is in the form of a thin outer wall shaped as a truncated cone. The open, circular top, A, provides the entrance and exit for fluids. The circular base, B, is sealed to the outer wall and its diameter is in a 3:2 ratio to the diameter of the circular top of the cup. This design provides for the bulk of the liquid contents to be closer to the base, than in most cups, and thus the center of gravity is shifted toward the base, resulting in greater stability and resistance to accidental tipping. The other advantage of this vessel is depicted in FIG. 2 which shows a crosssection of the cup. The base is formed by an inverted, hollow cone, (C) whose wall forms a ridge nearly midway such that another identical cup may nest snugly against that ridge (D) and thus be stacked. The design thus provides for a more stable cup which can nest, one upon the other.

I claim:

1. A drinking cup having an outer wall in the shape of an inverted, truncated cone with a circular base wider than a circular top in a 3:2 ratio, said cup having a bottom connected to said outer wall and shaped as a hollow inverted cone, a ridge located on the hollow inside surface substantially midway of said cone to receive the circular top of another identical cup for the purpose of stacking.

* * * * *